US005353036A

United States Patent [19]

Baldry

[11] Patent Number: 5,353,036

[45] Date of Patent: Oct. 4, 1994

[54] DUAL ANTENNA ASSEMBLY WITH ANTENNA RETRACTION INACTIVATION

[75] Inventor: Frank Baldry, Haslemere, England

[73] Assignee: Nokia Mobile Phones (U.K.) Limited, Surrey, United Kingdom

[21] Appl. No.: 910,652

[22] Filed: Jul. 8, 1992

[30] Foreign Application Priority Data

Jul. 13, 1991 [GB] United Kingdom ..... 9115134

[51] Int. Cl.[5] ..... H01Q 1/24

[52] U.S. Cl. ..... 343/702; 343/900; 343/895

[58] Field of Search ..... 343/702, 900, 901, 749, 343/752, 895, 725, 729; H01Q 1/24

[56] References Cited

U.S. PATENT DOCUMENTS

| | | | |
|---|---|---|---|
| 2,948,894 | 8/1960 | Carpenter, Jr. | 343/725 |
| 3,087,117 | 4/1963 | Mitchell | 343/702 |
| 4,190,841 | 2/1980 | Harada | 343/903 |
| 4,523,197 | 6/1985 | Imazeki et al. | 343/901 |
| 4,525,718 | 6/1985 | Imazeki et al. | 343/901 |
| 4,725,845 | 2/1988 | Phillips | 343/702 |
| 4,868,576 | 9/1989 | Johnson, Jr. | 343/702 |
| 4,920,352 | 4/1990 | Martensson et al. | 343/702 |
| 4,989,012 | 1/1991 | Martensson et al. | 343/702 |
| 5,072,230 | 12/1991 | Taniyoshi et al. | 343/722 |
| 5,177,492 | 1/1993 | Tomura et al. | 343/702 |
| 5,204,687 | 4/1993 | Elliott et al. | 343/895 |

FOREIGN PATENT DOCUMENTS

| | | | |
|---|---|---|---|
| 0301175 | 2/1989 | European Pat. Off. | 343/702 |
| 0359361A1 | 3/1990 | European Pat. Off. . | |
| 0467822A2 | 1/1992 | European Pat. Off. . | |
| 63-69302 | 3/1988 | Japan | 343/702 |
| 3-245603 | 11/1991 | Japan | 343/702 |
| WO92/16980 | 10/1992 | PCT Int'l Appl. . | |
| 2219911A | 12/1089 | United Kingdom . | |
| 828213 | 2/1960 | United Kingdom . | |
| 1507076 | 4/1978 | United Kingdom . | |
| 2185634 | 7/1987 | United Kingdom . | |
| 2185635 | 7/1987 | United Kingdom . | |
| 2219911 | 12/1989 | United Kingdom . | |

*Primary Examiner*—Donald Hajec
*Assistant Examiner*—Hoanganh Le
*Attorney, Agent, or Firm*—Perman & Green

[57] ABSTRACT

An antenna assembly comprises an elongate antenna element (11) mounted in a support (5) and movable between a retracted position (see FIG. 2) and an extended position (see FIG. 1). A helical antenna element (12) is carried at one end of the elongate element. The support (5) comprises a pair of concentric conductors (9,10) which provide a coaxial feed to the antenna elements (11, 12). Suitably the support (5) comprises a dielectric tube (6) having respective conductive portions (9,10) provided on the inner and outer faces thereof. The elongate antenna element is slidably mounted within the central conductor (9). In the retracted position both ends of the elongate antenna element are electrically connected to the central conductor (9). The elongate antenna element is thus rendered inactive as a radiating element and essentially becomes part of the central coaxial feed coupled directly to the helical antenna element. The invention provides a compact and convenient dual antenna arrangement ideally suited for use in a portable cellular radio telephone.

23 Claims, 2 Drawing Sheets

DUAL ANTENNA ASSEMBLY WITH ANTENNA RETRACTION INACTIVATION

This invention relates to an antenna assembly comprising a retractable antenna which may be applied, for example, to a portable radio and, in particular a hand portable radio telephone.

BACKGROUND OF THE INVENTION

A radio intended for two-way communication generally operates with either an external fixed rod or retractable antenna, or with an internal antenna. The fixed rod type of antenna has a predetermined length. Whilst such antennas can be relatively short, they are not conducive to a compact design nor are they particularly suitable for a radio intended to be carried in a pocket or other receptacle offering restricted space. On the other hand, retractable antennas are convenient for this purpose because they can be folded away when the radio is not in use. Retractable antennas are commonly of the telescopic tube type, although retractable fixed length antennas are also known.

Some known portable radios such as that disclosed in U.S. Pat. No. 3,087,117 have two antennas, i.e. an internal element together with a retractable element, and are also equipped with means for automatically switching between the two elements according to the physical position of the retractable element. Hence the retractable antenna is operable in the extended position, while the internal antenna element becomes operable when the retractable element is in the retracted position.

An important consideration with a dual antenna system is that both antennas should provide efficient operation under different conditions as appropriate. For example, while the external antenna element may provide better sensitivity and range performance during normal use, the less efficient internal antenna must provide satisfactory performance during stand-by operation.

U.S. Pat. No. 4,868,576 discloses an antenna for a portable cellular telephone comprising a helical coil at the base of a retractable elongate radiating element. The retractable element, which extends through the helical coil, has non-conductive portions at its two ends whereby in the extended position the elongate element is capacitively coupled to the helical coil, and in the retracted position the elongate element is substantially decoupled therefrom. The helical coil is fixedly mounted on the housing of the radio transceiver.

SUMMARY OF THE INVENTION

According to the present invention there is provided an antenna assembly comprising an elongate antenna element mounted in a support and movable between a retracted position and an extended position, and a helical antenna element carried by one end of the elongate antenna element, wherein the elongate antenna element is rendered inactive as a radiating means by movement to the retracted position.

An antenna assembly in accordance with the present invention provides a compact and convenient dual antenna arrangement which is ideally suited for portable radio applications and which can be manufactured and assembled in a relatively straightforward manner and therefore at low cost. Both the antenna elements may be external to the radio housing for optimum radiation performance. In the extended position the elongate antenna element is active, either alone or in combination with the helical antenna element. In the retracted position the elongate antenna element is rendered inactive so that the more compact helical antenna element alone performs the sole antenna function. In a preferred embodiment conductive feed means are coupled to the antenna elements and the elongate antenna element remains connected to said conductive means in the retracted position.

It is noted that the term "elongate antenna element" as used herein encompasses for example a rod type antenna or a coil type antenna having a generally elongate configuration. Also the term "helical" is not restricted to a helix having a uniform diameter but is intended to include a coil having a progressively widening diameter, viz. a spiral configuration.

By contrast with the antenna configuration disclosed in U.S. Pat. No. 4,868,576, in a preferred embodiment of an antenna assembly in accordance with the present invention the helical antenna element is carried by the end of the elongate element remote from the support when the elongate antenna element is in the extended position.

Suitably the antenna support comprises an electrically conductive portion adapted substantially to enclose the elongate antenna element in the retracted position. Preferably the support comprises a pair of coaxial conductors which provide the feed means to the antenna elements, the elongate antenna element being electrically coupled to the central conductor of the coaxial pair. The support may comprise a dielectric tube, the coaxial conductors being provided respectively on the internal and external faces of said dielectric tube. Alternatively, the support may comprise a pair of self-supporting concentric cylinders spaced apart, e.g. by an air gap. In either case the elongate antenna element may be slidably mounted within the central conductor such that an electrically conductive part, preferably at the inner end thereof, physically contacts, and so is electrically coupled to, the central conductor of the coaxial pair.

In the preferred embodiment means are disposed at the outer end of the elongate antenna element adjacent the helical antenna element which electrically connect the outer end of the elongate element to the central conductor of the coaxial pair when the elongate antenna element is in the retracted position. Hence both ends of the elongate antenna element are coupled to the central conductor when the elongate antenna element is retracted. The elongate antenna element is thus rendered inactive as a radiating means and becomes a functional part of the central conductor.

In one embodiment the helical antenna element may at all times remain electrically coupled to the elongate antenna element. In this case common contact means may be provided which electrically connect the helical antenna element to the central conductor of the coaxial pair and which also serve to connect the elongate antenna element to the central conductor of the coaxial pair when the elongate antenna element is in the retracted position. The elongate antenna element, when retracted, thus becomes a functional part of the coaxial feed to the helical antenna element.

The contact means suitably comprise a fixed electrical connector present on the support, and a movable electrical connector coupled to the helical antenna element, which movable connector engages the fixed connector when the elongate antenna element is in the retracted position. The two connectors may be in the form of respective concentric colletts.

BRIEF DESCRIPTION OF THE DRAWINGS

An embodiment of the invention will now be described, by way of example, with reference to the accompanying drawings in which.

DETAILED DESCRIPTION OF THE INVENTION

Figure 1:
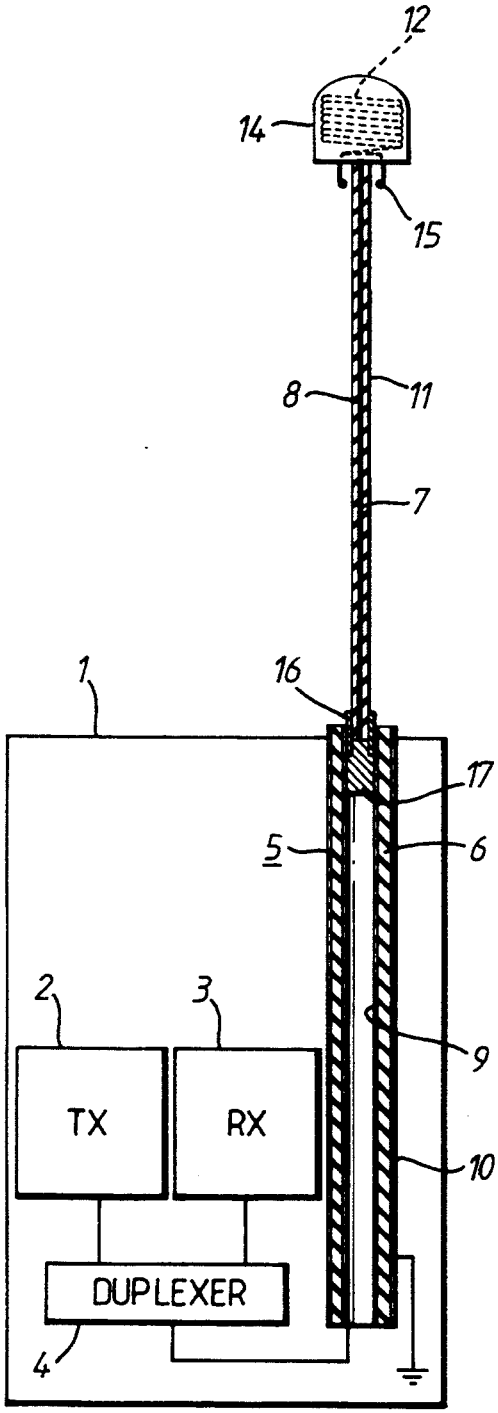
FIG. 1 is a schematic cross-section of a portable cellular radio telephone incorporating an antenna assembly in accordance with the present invention, showing the antenna in the extended position.

The portable cellular radio telephone shown in the Figures comprises a housing 1 enclosing a conventional transmitter 2 and receiver 3 coupled respectively via a duplexer 4 to the inner conductor 9 of the coaxial feed to the antenna assembly. The coaxial feed is discussed in more detail below.

The housing 1 also encloses all the other features conventionally found in a portable cellular telephone. Since these aspects are not directly relevant to the instant invention no further details will be given here.

The antenna assembly, provided adjacent the top face of the radio housing 1, comprises a support 5 in the form of a dielectric tube 6. The dielectric material of the tube 6 may, for example, be polytetrafluoroethylene (PTFE) or polyethylene. The bore of the dielectric tube 6 is provided with a conductive coating 9, for example of nickel plated copper. A conductive coating 10, for example of copper is also provided on the outer face of the tube 6. The inner and outer conductive coatings 9 and 10 are electrically isolated from each other. The inner and outer conductors may alternatively be formed by metal cylinders spaced apart by the dielectric tube 6. The outer conductor is electrically connected to ground potential, the ground metallization suitably being provided on the internal faces of the housing 1. Hence, the support 5 constitutes a coaxial feed to the antenna elements which will now be described.

The antenna assembly comprises two distinct antenna elements, namely an elongate antenna element 11 and a helical element 12. The elongate element comprises a central conductor 7 which may be a solid rod antenna or, alternatively, may be in the form of a close-wound coil which not only enhances flexibility of the elongate element and so reduces the risk of breakage, but also reduces the physical length of the antenna. The coil may be made of silver plated beryllium-copper wire. The elongate antenna element 11 may be chosen to have an equivalent electrical length, for example, of a quarter-wavelength or three-eights wavelength. The conducting portion 7 of the elongate element 11 is enclosed within an insulating sleeve 8 made for example of a flexible plastics material. At the base of the elongate antenna element there is provided an impedance matching inductor 13 having one end connected to the conductor 7 of the elongate antenna element 11 and the other end connected to an electrically conductive end portion 17 which is in electrical contact with the inner conductor 9 of the dielectric tube 6 (see FIG. 3). The inductor 13 is present within the insulating sleeve 8. The end portion 17 of the elongate antenna element 11 has a circumferential recess 20 which accommodates a radially biassed phosphor bronze spring 21. The conductive spring 21 bears against the inner conductor 9 of the support 5 for optimal electrical contact therewith.

The elongate antenna element 11 is slidably mounted in the bore of the dielectric tube 6 and the conductive spring 21 remains in electrical contact with the inner conductor 9 at all times.

The end of the elongate antenna element 11 remote from the support 5 carries a helical antenna element 12. The helical coil 12 is very compact and has a short physical length but is wider in diameter than the elongate antenna element 11. The effective electrical length of the helical antenna element 12 is, for example, a quarter-wavelength. The helical coil 12 is embedded in a dome-shaped dielectric encapsulation 14.

In the present embodiment the helical antenna element 12 is permanently electrically connected to the elongate antenna element 11. The lower end of the helical coil 12 is also electrically connected to a contact member in the form of a collett 15 which protrudes through the underside of the encapsulation 14. A complementary contact in the form of an electrically conductive collett 16 is provided within the upper end of the support 5. The collett 16 is provided in the bore of the tube 6 and is electrically connected to the inner conductor 9.

When the antenna is in the extended position as shown in FIG. 1, the electrically conductive end portion 17, which is coupled to the lower end of the impedance matching inductor 13, makes electrical contact via the conductive spring 21 with the inner conductor 9 on the support 5. The support 5 thus acts as a coaxial feed to the elongate antenna element. As mentioned previously, the inner conductor 9 on the dielectric tube is coupled to the radio transmitter 2 and receiver 3 via a duplexer 4. Since the helical antenna element 12 is connected to the elongate antenna element 11 both elements are functionally active as a combined antenna in the extended position.

Figure 3:
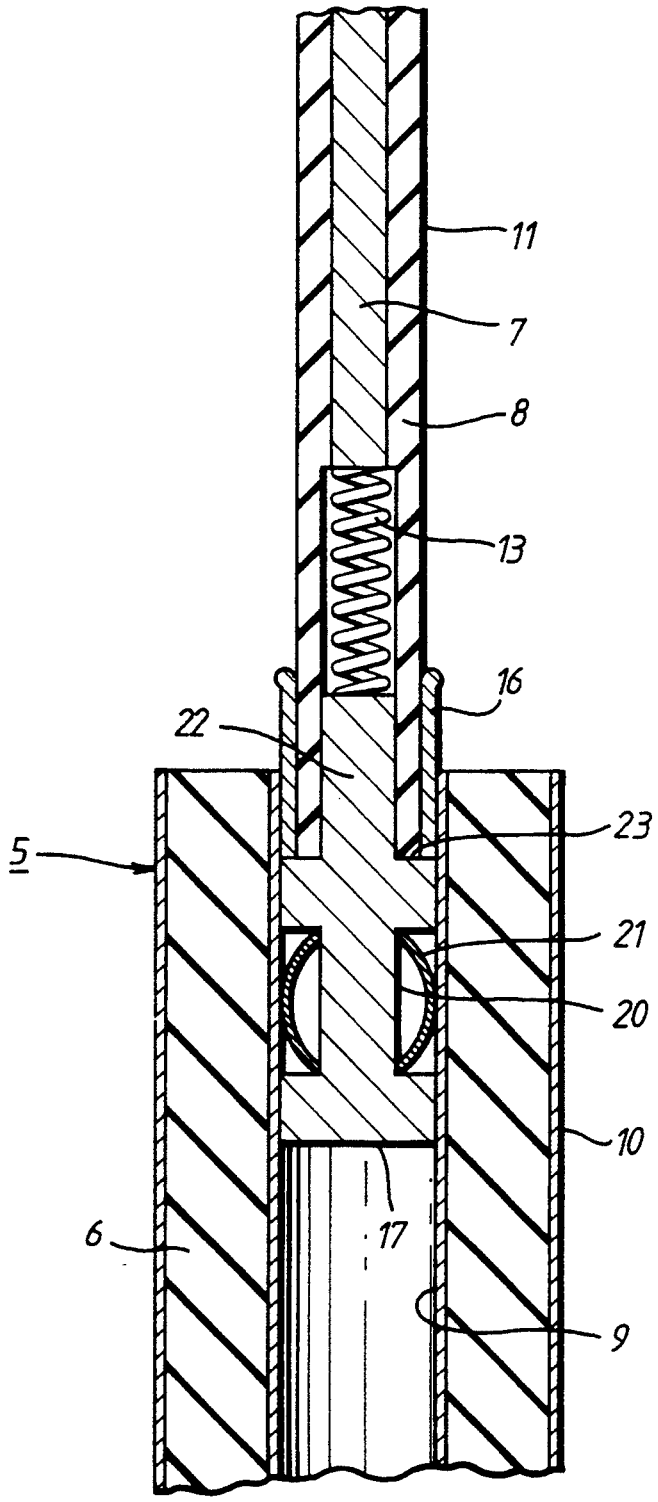
FIG. 3 is an enlarged cross-section showing a portion of the antenna and support in more detail.

As can be seen most clearly in FIG. 3, the end portion 17 has a narrower portion 22 adjacent the inductor 3 defining a shoulder 23 which abuts the underside of the collett 16 when the antenna is fully extended and so acts as a stop to prevent further withdrawal of the antenna.

Figure 2:
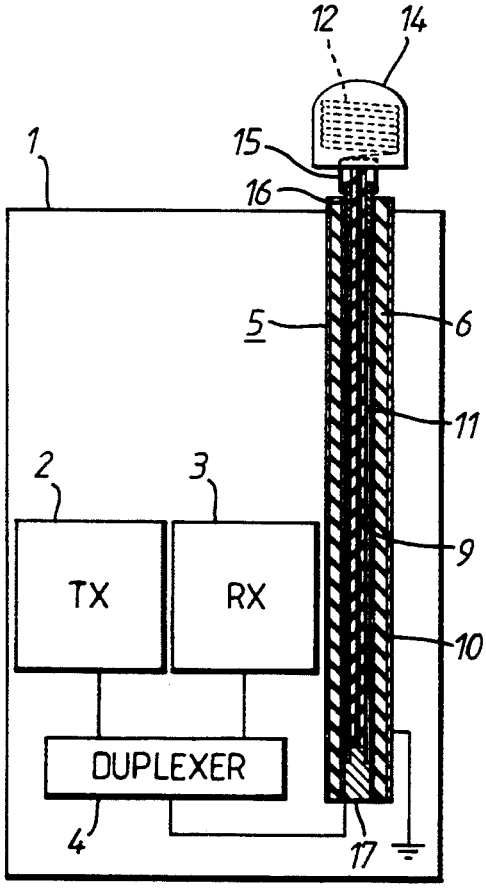
FIG. 2 is a schematic cross-section of the portable cellular radio telephone in FIG. 1 showing the antenna in the retracted position.

In the retracted position shown in FIG. 2, the elongate antenna element is substantially entirely enclosed within the coaxial support 5. The conductive end portion 17 nevertheless remains in electrical contact with the inner conductor 9 via the conductive spring 21. Also, the conductive collett 15 depending from the helical antenna element 12 now engages, and hence makes electrical contact with, the complementary conductive collett 16 at the top end of the coaxial support 5. The elongate antenna element is thus rendered inactive as a radiating element in that it essentially becomes part of the central coaxial feed coupled directly to the helical antenna element 12. The helical antenna element is thus electrically coupled directly to the central conductor of the coaxial feed. The collett pair 15 and 16 constitutes both a low inductance, low resistance antenna switch and also a detent feature by which the user is able to feel when the antenna is fully retracted. When the antenna is extended the contact between colletts 15 and 16 is broken. The outer end of the elongate antenna element is therefore no longer connected to the inner conductor 9 of the coaxial support and the extended portion of the elongate element resumes its function as a radiating antenna element.

It is noted here that the characteristic impedance $Z_o$ of the respective transmission lines which feed the elongate antenna element 11 and the helical antenna element 12 when the elongate antenna element is respectively extended and retracted is substantially the same despite the different nature of the central conductor in the two cases. This is because, in the case of a coaxial transmission line with a circular cross-section, $Z_o$ is determined by the equation $$Z_o = \frac{60}{\sqrt{(\epsilon_r)}} \ln (d_o/d_i)$$

where $\epsilon_r$ is the relative permittivity of the dielectric material of tube 6, $d_o$ is the diameter of the outer conductor of the coaxial feed, and $d_i$ is the diameter of the inner conductor of the coaxial pair. Clearly $\epsilon_r$, and $d_o$ do not change between the extended and retracted positions. More significantly, however, it will be seen that with the present arrangement $d_i$ does not change since the overall diameter of the central conductor 9 is fixed and is not altered by the action of the elongate antenna element 11 sliding internally within the inner conductor 9.

In an alternative embodiment the helical antenna element 12 may be electrically isolated from the elongate antenna element 11. In this case contact means such as a conductive member extending through the insulating sleeve 8 may be provided for electrically connecting the outer end of the elongate element to the inner conductor 9 of the coaxial support when the antenna is in the fully retracted position. In the retracted position the collett switch 15, 16 would still be effective to couple the helical antenna element 12 to the central conductor of the coaxial feed. The collett pair 15 and 16 thus constitute a low inductance, low resistance antenna switch for the helical antenna element 12. When the antenna is extended the contact between colletts 15 and 16 is broken thus decoupling the helical antenna element. Also electrical contact is broken between the contact means at the outer end of the elongate antenna element 11 and the inner conductor 9 of the coaxial support whereby the elongate element, which remains electrically coupled at the lower end portion 17 to the inner conductor 9, resumes its function as a radiating antenna.

In view of the foregoing description it will be evident to a person skilled in the art that various modifications may be made within the scope of the present invention. For example, instead of being formed of a solid dielectric tube the antenna support may comprise a pair of concentric metal cylinders held in spaced relationship by insulating spacers. In this case the dielectric may be the air in the gap between the concentric cylinders. Furthermore, it is noted here that neither the dielectric tube and the bore thereof, nor the concentric metal cyclinders need be circular in cross-section, but may instead be square, rectangular, oval or indeed any other suitable shape.

I claim:

1. A dual antenna assembly comprising a first antenna having an elongate antenna element mounted in a support and movable between a retracted position and an extended position, a second antenna having a helical antenna element carried by one end of the elongate antenna element, wherein the elongate antenna element is rendered inactive as a radiating means by movement to the retracted position, coupling means effective when the elongate antenna element is in the retracted position to render the helical antenna element operable as a radiating means and conductive feed means coupled to said antenna elements, wherein the elongate antenna element is directly connected to said conductive feed means in the retracted position.

2. An antenna assembly as claimed in claim 1, wherein the support comprises a pair of coaxial conductors providing said feed means to the antenna elements, the elongate antenna element being electrically coupled to the central conductor of the coaxial pair.

3. An antenna assembly as claimed in claim 2, wherein the elongate antenna element is slidably mounted within the central conductor.

4. An antenna assembly as claimed in claim 2, wherein means are provided at the end of the elongate antenna element opposite said one end which electrically couple said opposite end of the elongate antenna element to the central conductor of the coaxial pair.

5. An antenna assembly as claimed in claim 2, including means disposed at said one end of the elongate antenna element which electrically connect said one end of the elongate antenna element to the central conductor of the coaxial pair when the elongate antenna element is in the retracted position.

6. An antenna assembly as claimed in claim 2, wherein the support comprises a dielectric tube and the coaxial conductors are provided respectively on the internal and external faces of said tube.

7. An antenna assembly as claimed in claim 2, wherein the coaxial conductors of the support comprise a pair of concentric conductive cylinders in spaced relationship.

8. An antenna assembly as claimed in claim 2, including contact means which electrically connect the helical antenna element to the central conductor of the coaxial pair when the elongate antenna element is in the retracted position.

9. An antenna assembly as claimed in claim 8, wherein the contact means comprise a fixed electrical connector present on the support, and a movable electrical connector coupled to the helical antenna element, which movable connector engages the fixed connector when the elongate antenna element is in the retracted position.

10. An antenna assembly as claimed in claim 9, wherein the fixed connector and the movable connector are in the form of respective concentric colletts.

11. An antenna assembly as claimed in claim 8, wherein the contact means also connects the elongate antenna element to the central conductor of the coaxial pair when the elongate antenna element is in the retracted position.

12. An antenna assembly as claimed in claim 1, wherein the helical antenna element is present at the end of the elongate antenna element remote from the support when the elongate antenna element is in the extended position.

13. A portable radio transceiver comprising:

a housing enclosing transmitting and receiving circuitry, and an antenna assembly comprising a first elongate antenna mounted in a support and movable between a retracted position and an extended position, a second helical antenna carried by one end of the first elongate antenna, wherein the first elongate antenna being rendered inactive as a radiating means by movement to the retracted position, and coupling means effective when the first elongate antenna is in the retracted position to render the second helical antenna operable as a radiating means, said antenna assembly being coupled to said transmitting and receiving circuitry by conductive feed means, wherein the elongate antenna remains directly connected to said conductive feed means in the retracted position.

14. An antenna assembly comprising a first elongate antenna element movable between a retracted position and an extended position, a second antenna element carried by one end of the first elongate antenna element, and a pair of substantially concentric conductors providing coaxial feed means to said first and second antenna elements, wherein in the retracted position said first antenna element constitutes at least a substantial part of said coaxial feed means to said second antenna element.

15. An antenna assembly as claimed in claim 14, wherein said first antenna element is slidably mounted within the inner conductor of said concentric pair of conductors.

16. An antenna assembly as claimed in claim 14, wherein said first antenna element is slidably mounted in a support, said concentric conductors being provided on said support.

17. An antenna assembly as claimed in claim 16, wherein said support comprises a dielectric tube and said concentric conductors are provided respectively on the internal and external faces of said tube.

18. An antenna assembly as claimed in claim 14, wherein said concentric conductors comprise a pair of self-supporting conductor cylinders in spaced relationship.

19. An antenna assembly as claimed in claim 14, wherein said feed means are provided at one end of said first antenna element which electrically couple said one end of said first antenna element to said inner conductor of said concentric pair of conductors.

20. An antenna assembly as claimed in claim 19, wherein means are provided at the other end of said first antenna element which electrically connect said other end of said first antenna element to said inner conductor of said concentric pair of conductors when said first antenna element is in the retracted position.

21. An antenna assembly as claimed in claim 14, including contact means which electrically connect said second antenna element to said inner conductor of said concentric pair of conductors when said first antenna element is in the retracted position.

22. An antenna assembly as claimed in claim 21, wherein said contact means also connect said first antenna element to said inner conductor of said concentric pair of conductors when said first antenna element is in the retracted position.

23. A portable radio transceiver comprising a housing enclosing transmitting and receiver circuitry, and an antenna assembly as claimed in claim 14, said antenna assembly being coupled to said transmitting and receiving circuitry.

* * * * *